US005676074A

United States Patent [19]

Bengal

[11] Patent Number: 5,676,074

[45] Date of Patent: Oct. 14, 1997

[54] GARMENT FENCE FOR AN EMBROIDERY HOOP

[76] Inventor: David C. Bengal, 6554 Seneca Trial, Mentor, Ohio 44060

[21] Appl. No.: 506,415

[22] Filed: Jul. 24, 1995

[51] Int. Cl.[6] ..... D05C 1/02; D06C 3/08

[52] U.S. Cl. ..... 112/103; 38/102.2

[58] Field of Search ..... 112/103, 102.5, 112/102, 470.14, 475.18; 38/102, 102.2, 102.91; 101/127.1; 160/371, 373, 380

[56] References Cited

U.S. PATENT DOCUMENTS

| | | | |
|---|---|---|---|
| 519,258 | 5/1894 | Hill | 38/102.2 |
| 1,944,690 | 1/1934 | Karle | 112/103 |
| 4,598,488 | 7/1986 | Inteso | 112/103 X |
| 5,413,057 | 5/1995 | Moore, III | 112/102.5 X |

FOREIGN PATENT DOCUMENTS

| | | | |
|---|---|---|---|
| 2221454 | 9/1990 | Japan | 38/102.2 |

*Primary Examiner*—Ismael Izaguirre
*Attorney, Agent, or Firm*—Frank B. Robb; John H. Vynalek

[57] ABSTRACT

A garment fence for an embroidery hoop having an inner and outer hoop defining a sewing field and used for embroidering garments, and comprising a frame having a top and bottom edge inserted within the embroidery hoop and barrier device attached to the frame at the top edge and extending upwardly therefrom. The barrier device insures unimpeded movement of the embroidery hoop and such that the garment is controlled to insure that only the portion of the garment intending to be embroidered enters the sewing field.

4 Claims, 2 Drawing Sheets

GARMENT FENCE FOR AN EMBROIDERY HOOP

BACKGROUND OF THE INVENTION

The present invention relates generally to garment embroidery systems and, more particularly, to garment embroidery systems utilizing computerized controlled embroidery machines.

Garment embroidery systems employ state-of-the-art technology to produce an almost infinite variety of designs, styles, colors and applications. This technology takes advantage of user friendly software in combination with a PC and specialized peripherals to create multiple color and intricately detailed designs for garments. Due mainly to this technology the embroidery industry grew by 91% over the last four years.

The technology is based on an x-y orthogonal axis application utilizing a sewing head and embroidery hoop. The sewing head has one or more needles and is attached to the embroidery machine by way of an arm. The sewing head moves along the arm with the position of the head on the arm determining which needle will be used. Each needle is threaded with a different color thread for multiple color designs. Depending on which needle is used the sewing head may protrude several inches past either end of the arm. The embroidery hoop is used to tightly hold the garment to be embroidered and has a fastener which allows it to be attached to the "pantagram arm" of an embroidery machine. The pantagram arm moves the embroidery hoop and garment in the x-y axis as required by the particular design. The movement of the pantagram arm and embroidery hoop control the position of the garment under the sewing head thereby controlling the design, while the movement of the sewing head controls the selection and operation of a needle thereby controlling the color of the design.

The movement of the pantagram arm, and thereby, the embroidery hoop, tends to allow the portion of the garment not being embroidered to work its way into the sewing field and also become sewn. This is especially true for smaller sized garments. When this happens the garment is mined and rendered useless. Because of this the embroidery machine operator must keep a constant watch to insure that this does not occur. Also the garment must be restrained with tape or some other device, which is very time consuming.

Accordingly, a need exists for a device which controls the garment to insure that only the portion of the garment intending to be embroidered enters the sewing field without impeding the movement of the embroidery hoop

SUMMARY OF THE INVENTION

The present invention provides a device to satisfy the aforementioned needs.

Accordingly, the present invention is directed to a garment fence for an embroidery hoop having an inner and outer hoop defining a sewing field and used for embroidering garments, and comprises a frame having a top and bottom edge inserted within the embroidery hoop and barrier means attached to the frame at the top edge and extending upwardly therefrom. The barrier means insures unimpeded movement of the embroidery hoop and such that the garment is controlled to insure that only the portion of the garment intending to be embroidered enters the sewing field.

BRIEF DESCRIPTION OF THE DRAWINGS

Further features of the present invention will become apparent to those skilled in the art to which the present invention relates from reading the following specification with reference to the accompanying drawings in which.

DESCRIPTION OF THE PREFERRED EMBODIMENT

Figure 1:
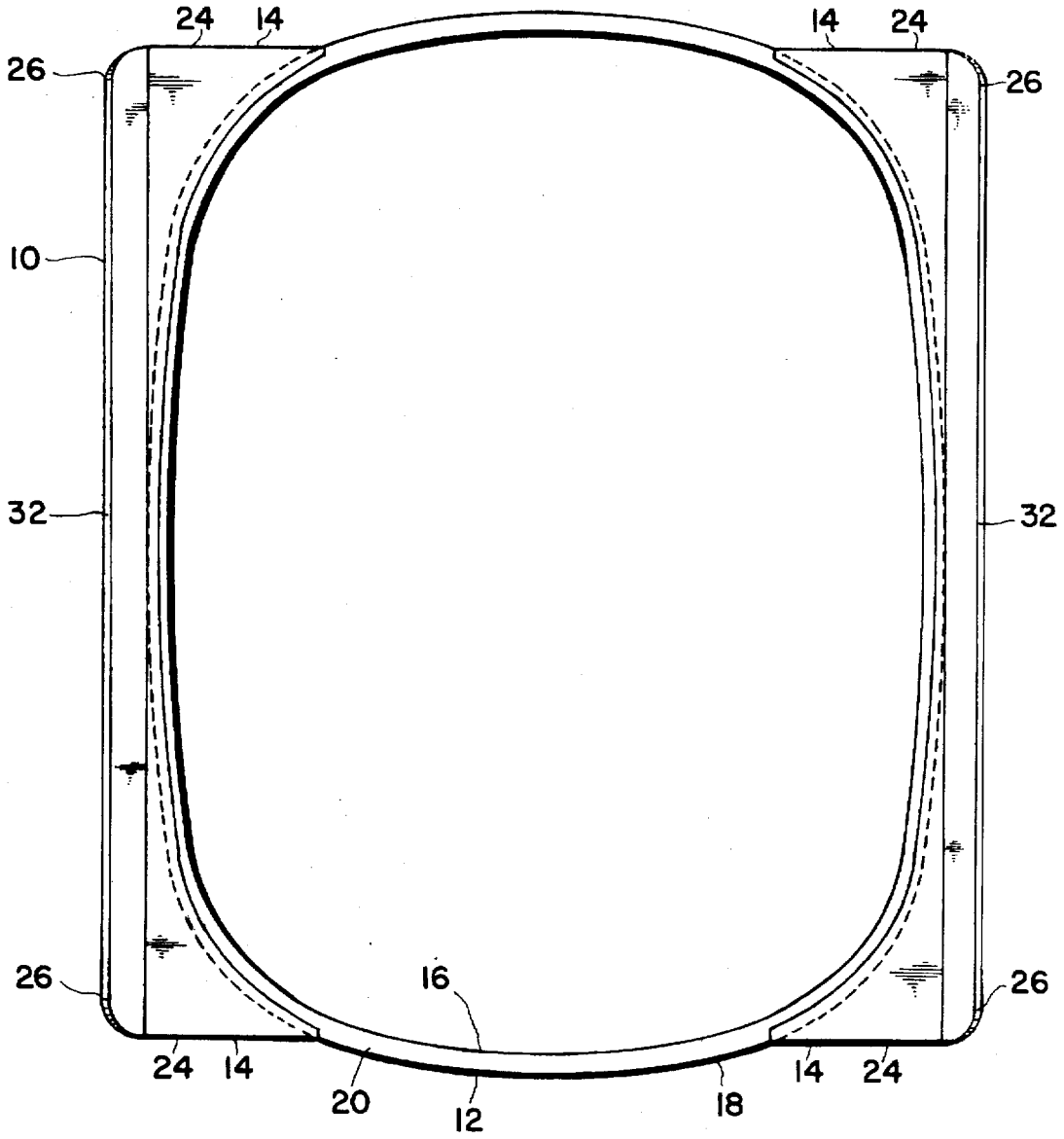
FIG. 1 is a top view of the present invention.
Figure 1A:
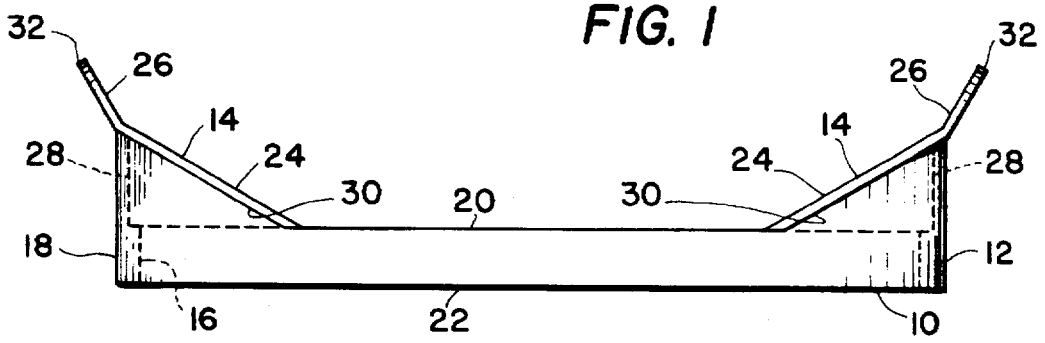
FIG. 1A is a side elevation of the present invention.

Referring now to the drawings and, in particular to FIG. 1 there is shown a top view of the present invention 10, and to FIG. 1A there is shown a side elevation of the present invention 10. The present invention 10 is comprised of frame 12 and barrier means 14. The frame 12 has an inner face 16 and an outer face 18. The inner face 16 defines the boundaries of a framed space. Although, in the preferred embodiment of the present invention the frame 12 is generally oval shaped, it can be other shapes, including circular, square or rectangular. The frame 12 has a top edge 20 and a bottom edge 22. Barrier means 14 extend upwardly from the top edge 20 of the frame 12. The barrier means 14 is open at two opposing lengths along the frame 12. In the preferred embodiment of the present invention, the barrier means 14 is composed of first and second segments 24 and 26, respectively. The first segment 24 has a base 28 and an angled top portion 30. The top portion 30 is at an angle of 30 degrees measured from the horizontal. The second segment 26 extends upwardly from the first segment 24 at an angle of 60 degrees measured from the horizontal. The second segment 26 terminates in straight ends 32 which are generally parallel to the longitudinal axis of oval formed by the frame 12.

Figure 2:
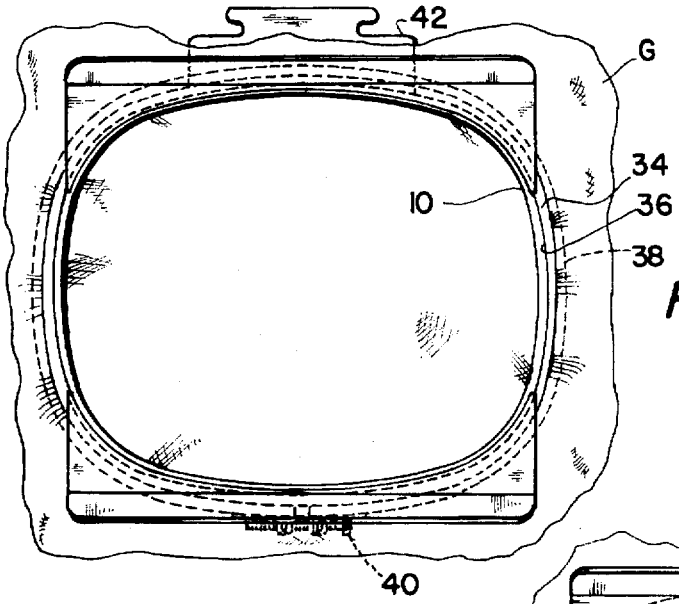
FIG. 2 is a top view of the present invention installed in an embroidery hoop in one application.

Referring now to FIG. 2 there is shown a top view of the present invention 10 installed in an embroidery hoop 34. Although, an oval embroidery hoop 34 is shown, it is understood by those skilled in the art that an embroidery hoop 34 can be circular, square or rectangular. The embroidery hoop 34 is composed of an inner hoop 36, an outer hoop 38, a screw adjustment 40 and a fastener 42. The embroidery hoop 34 is used to secure a garment "G" to be embroidered. The garment "G" is placed between the inner hoop 36 and the outer hoop 38. The screw adjustment 40 is used to tighten the outer hoop 38 against the garment "G" and the inner hoop 36 thereby securing the garment "G" between the two. The fastener 42 is used to attach the embroidery hoop 34 to an embroidery machine 44 (not shown on FIG. 2). In one application, as shown in FIG. 2, the present invention 10 is inserted inside the inner hoop 36 after it is tightened against the garment "G" and the outer hoop 38.

Figure 3:
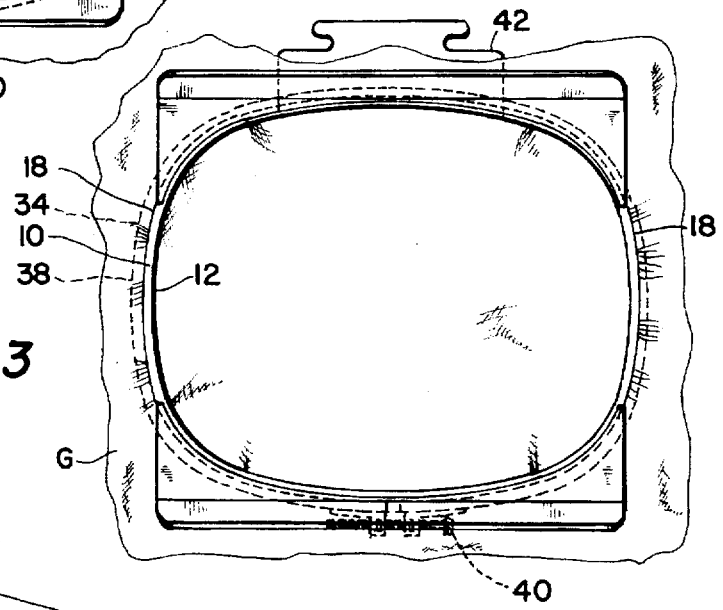
FIG. 3 is a top view of the present invention installed in an embroidery hoop in another application.

In another application, shown in FIG. 3, the present invention 10 is inserted in the outer hoop 38 replacing and obviating the inner hoop 36 (not shown in FIG. 3). The garment "G" is placed between the outer hoop 38 and the outer face 18 of the frame 12. The screw adjustment 40 tightens the outer hoop 38 against the frame 12 in the same manner as it would have with respect to the inner hoop 36. The outer face 18 of the frame 12 is then in tight contact with the garment "G" and the outer hoop 38.

Figure 4:
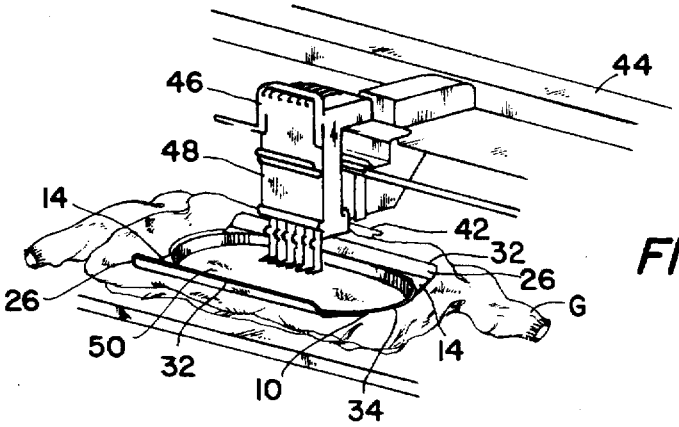
FIG. 4 is a perspective of the present invention and an embroidery hoop installed on a embroidery machine.

Referring now to FIG. 4, there is shown an embroidery hoop 34 with the present invention 10, both attached to an embroidery machine 44. The embroidery hoop 34 attaches to the pantagram arm 46 of the embroidery machine 44 by the fastener 42. The embroidery machine 44 also has a and a sewing head 48. The pantagram arm 46 moves the embroidery hoop 34 in x and y directions. The sewing head 48 performs the actual embroidery of the garment "G". The ends 32 of the second segment 26 of the barrier means 14 are parallel to the sewing head 48 while the openings of the barrier means 14 are perpendicular to the sewing head 48. This allows the sewing head 48 to embroider in the entire sewing field 50 with out obstruction. The barrier means 14 insures unimpeded embroidery hoop 38 movement and traps and maintains control of the garment "G" to insure that portions of the garment "G" not being embroidered do not enter into the sewing field 50.

Now that the invention has been described, variations and modifications will become apparent to those skilled in the art. It is intended that such variations and modifications be encompassed within the scope of the appended claims.

What is claimed is:

1. A garment fence for an embroidery hoop with an inner and outer hoop defining a sewing field and used for embroidering garments, comprising:

a) a frame having a top and a bottom edge inserted within said embroidery hoop such that when said frame is inserted within said outer hoop it replaces and obviates said inner hoop;

b) barrier means attached to said frame at said top edge and extending upwardly therefrom such that said barrier means insures unencumbered movement of said embroidery hoop and such that said garment is controlled to insure that only the portion of said garment intending to be embroidered enters said sewing field.

2. The garment fence of claim 1, wherein said barrier means is composed of first and second segments such that said first segment has a base and an angled top portion extending therefrom and said second segment extends angularly upwardly from said angled top portion of said first segment.

3. The garment fence of claim 2, wherein said angled top portion is at an angle of about 30 degrees measured to the horizontal.

4. The garment fence of claim 2, wherein said second segment is at an angle of about 60 degrees measured to the horizontal.

* * * * *